US008453476B2

(12) United States Patent
Kendall et al.

(10) Patent No.: US 8,453,476 B2
(45) Date of Patent: Jun. 4, 2013

(54) REFRIGERATOR MODULE MOUNTING SYSTEM

(75) Inventors: James W. Kendall, Mount Prospect, IL (US); Todd A. Zeilinger, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1049 days.

(21) Appl. No.: 12/469,915

(22) Filed: May 21, 2009

(65) Prior Publication Data

US 2010/0295435 A1 Nov. 25, 2010

(51) Int. Cl.
*F25D 11/00* (2006.01)

(52) U.S. Cl.
USPC ..... 62/440; 62/449

(58) Field of Classification Search
USPC ..... 62/407, 440, 449; 312/401, 237
See application file for complete search history.

(56) References Cited

U.S. PATENT DOCUMENTS 3,027,732 A 4/1962 Mann et al.
3,506,325 A 4/1970 Horvay
4,332,429 A 6/1982 Frick et al.
4,522,114 A 6/1985 Matsuno
4,671,074 A 6/1987 Gostelow et al.
4,820,189 A 4/1989 Sergeant et al.
4,864,519 A 9/1989 Appleby et al.
4,910,650 A 3/1990 Goralnik
4,912,942 A * 4/1990 Katterhenry et al. ..... 62/338
5,100,213 A 3/1992 Vandarakis et al.
5,225,632 A 7/1993 Gorin et al.
5,467,520 A 11/1995 Nunez et al.
5,485,397 A 1/1996 Yamazato et al.
5,555,189 A 9/1996 Yamazato et al.
5,620,243 A * 4/1997 Billingham ..... 312/259
5,706,170 A 1/1998 Glovatsky et al.
5,720,185 A 2/1998 Lee
5,722,252 A 3/1998 Kang et al.
5,754,398 A 5/1998 Glovatsky et al.
5,811,732 A 9/1998 Beam
5,884,496 A 3/1999 Kim et al.
5,941,619 A * 8/1999 Stieben et al. ..... 312/223.6
5,996,370 A 12/1999 Lee
6,065,821 A 5/2000 Anderson et al.
6,073,458 A 6/2000 Kim
6,126,228 A 10/2000 Davis, Jr. et al.
6,257,897 B1 7/2001 Kubota
6,482,340 B1 11/2002 Davis, Jr. et al.
6,813,896 B1 11/2004 Janke et al.
7,093,453 B2 8/2006 Asan et al.
7,260,438 B2 8/2007 Caldwell et al.
7,338,180 B2 3/2008 Wing
7,343,757 B2 3/2008 Egan et al.

(Continued)

*Primary Examiner* — Melvin Jones
(74) *Attorney, Agent, or Firm* — Daniel M. Blakeslee; Kirk W. Goodwin

(57) ABSTRACT

An elongated spine extends vertically within a refrigerated cabinet, freezer cabinet, or doors and includes ductwork for the transmission of fluids within the spine as well as operating power and/or electrical control or data signals. The spine includes a mounting channel having inwardly extending edges. Modules mate with the spine for the physical mounting of the modules at any desired location within the continuously extending channel and are provided with a flange which fits within the spine and mounts the module in a cantilevered fashion to the refrigerator. Such construction facilitates the distribution of fluids, such as hot or cold air within the refrigerator, and the manufacturing of a refrigerator by providing a readily attached spine and allowing modular construction of a refrigerator with infinite adjustability for the user.

15 Claims, 9 Drawing Sheets

U.S. PATENT DOCUMENTS

2003/0121272 A1* 7/2003 Kim et al. ..... 62/125
2006/0196217 A1 9/2006 Duarte et al.
2007/0074527 A1 4/2007 Lee et al.
2008/0110198 A1 5/2008 Egan et al.
2008/0115522 A1 5/2008 Kim et al.
2009/0293511 A1* 12/2009 Allard et al. ..... 62/77

* cited by examiner

REFRIGERATOR MODULE MOUNTING SYSTEM

BACKGROUND OF THE INVENTION

The present invention relates to refrigerated cabinets and particularly to a system for mounting various modules, shelves, and bins at selected locations within the cabinets and for receiving utilities for the modules.

Typical refrigerators include adjustable shelves and bins with finite adjustment locations usually defined by either slotted tracks formed in a rear wall or grooves or other mounting structure formed along the sides of the refrigerator cabinets at spaced locations. This allows some adjustability of shelves for varying items being stored in the refrigerator and allows the consumer to select shelf heights for different items to be refrigerated. The refrigerator doors also frequently include bins which are incrementally adjustable at different but predetermined locations.

Newer concepts in refrigeration have included modular units which fit within a refrigerated cabinet and which provide the user with unique features, such as instant cooling, quick defrost, ice makers and water dispensers, and other features which can be selectably installed within a refrigerator and which frequently require utilities, such as a coolant fluid, electrical power, or electrical data signals for controlling the module. Examples of such improved modular refrigerator constructions which allow the owner new features which can be purchased with a refrigerator or subsequently added to a refrigerator are disclosed in U.S. patent application Ser. Nos. 12/402,559 entitled Vacuum Food Preservation System; 12/402,747 entitled Chilling and Thawing Modular Appliance System; and 12/402,731 entitled Modular Door Mounted Climate Controlled Medicine Compartment, all of which were filed on Mar. 12, 2009, and the disclosures of which are incorporated herein by reference.

Although such modules are themselves a great convenience for the users of the refrigerators so equipped, there remains a need for allowing the owner the flexibility of selecting a preferred location anywhere within the refrigerated cabinets for the installation of one or more such modules. Also it would be desirable to allow the consumer the flexibility of positioning shelves and bins at any desired height location instead of limiting the choice to incremental positions.

SUMMARY OF THE INVENTION

The system of the present invention satisfies this need by providing an elongated mounting member or spine supported by the refrigerator cabinet and including a continuously extending mechanical connector. The spine includes at least one of an electrical conductor or a fluid conduit. The system includes at least one module having a mating mechanical connector for coupling the module to the mechanical connector of the spine at a selected location. The module includes an additional connector for coupling to the spine for receiving operating power, data, or fluids from the spine at the selected location.

In one preferred embodiment of the invention, the spine extends vertically within at least one of the refrigerated cabinet, the freezer cabinet, and the doors and includes at least one duct for the transmission of fluids within the spine as well as electrical operating power and/or electrical control or data signals. The mechanical connector of the spine in one embodiment includes is a channel having inwardly extending edges, and the modules, shelves and bins which mate with the spine are provided with a mating mounting structure such as a flange for the physical mounting of the modules at any desired location within the continuously extending channel.

Such construction allows the modules, shelves, and beams to be mounted anywhere along the spine in a cantilevered fashion. The spines can be readily mounted to any wall of refrigerator cabinets and doors and provides a continuously adjustable mounting location for modules, bins, and/or shelves. This structure also facilitates the distribution of utilities contained within the spine to locations in the refrigerator cabinets. It also facilitates the manufacturing of a refrigerator by providing a readily attached spine allowing the modular construction of a refrigerator with greatly improved adjustability for the user.

These and other features, objects and advantages of the present invention will become apparent upon reading the following description thereof together with reference to the accompanying drawings.

DETAILED DESCRIPTION OF THE PREFERRED EMBODIMENT

Figure 1:
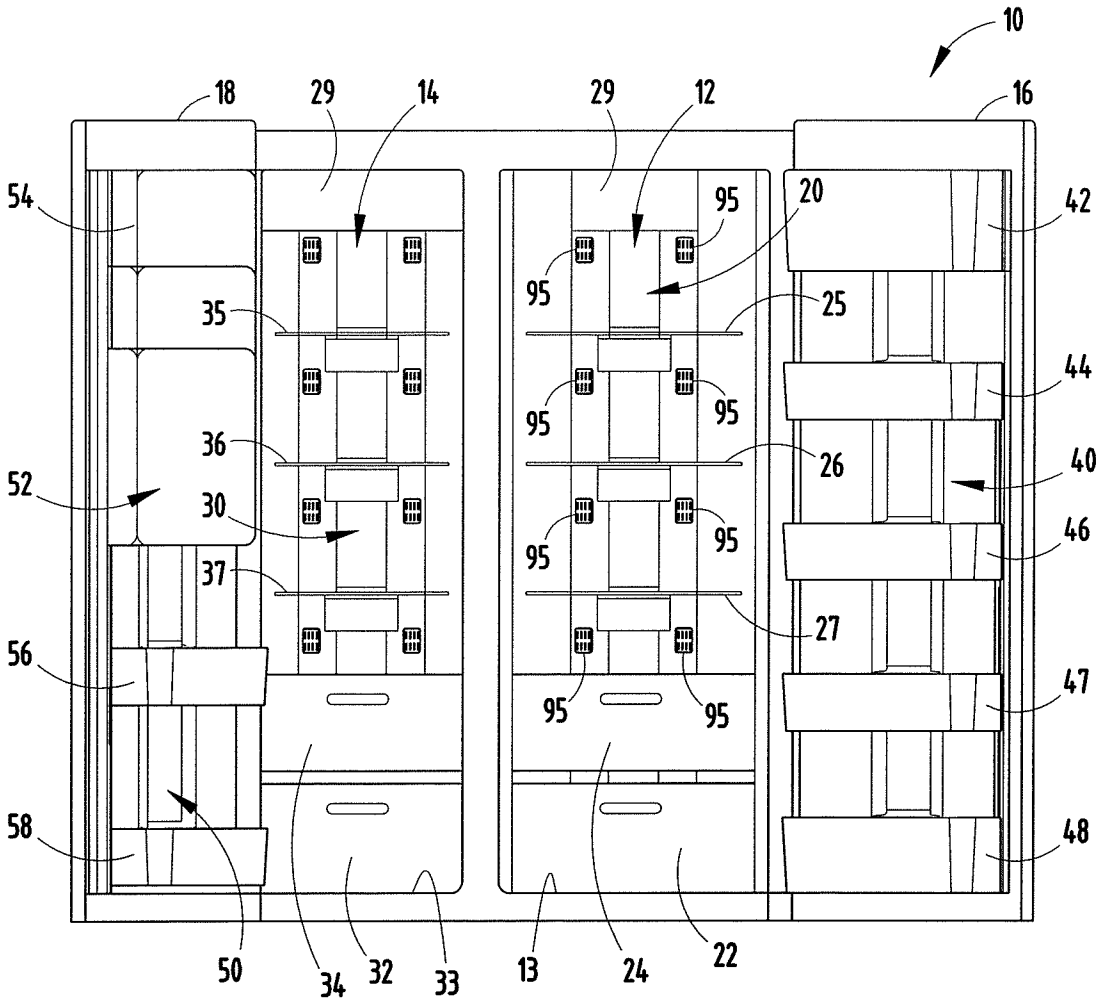
FIG. 1 is a front elevational view of a side-by-side refrigerator/freezer embodying the present invention.
Figure 2:
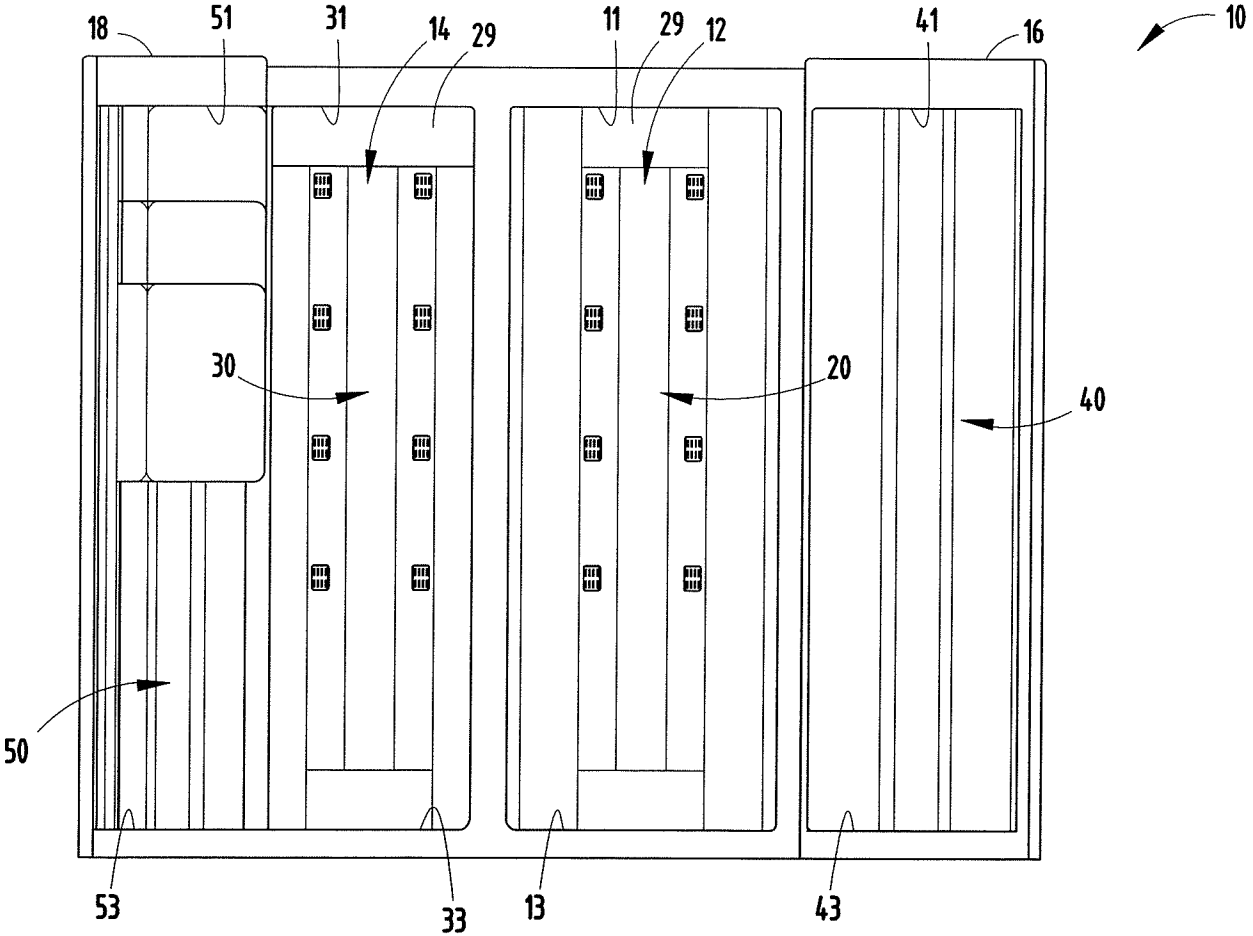
FIG. 2 is a front elevational view of the refrigerator/freezer shown in FIG. 1 with the modules largely removed to illustrate the location of spines therein.

Referring initially to FIGS. 1 and 2, there is shown a refrigerator 10, which comprises a side-by-side refrigerator and freezer section with a refrigerated cabinet 12 shown on the right side and a freezer cabinet 14 shown on the left side. Each of the cabinets 12, 14 are selectively enclosed by doors 16 and 18 respectively. Although a side-by-side refrigerator/freezer is illustrated in FIGS. 1 and 2, the invention is not limited to a side-by-side refrigerator/freezer or even a refrigerator with a freezer but can be used with any configuration of a refrigerator, a freezer and/or refrigerator/freezer including those with a freezer drawer on the bottom, a single door freezer, or a single door refrigerator. Thus, the system of the present invention can be employed with any configuration of a refrigerator, a freezer, and/or a refrigerator/freezer to provide the flexibility and convenience obtained with the system of the present invention.

The refrigerator 10, as best seen in FIG. 2, includes an elongated vertically extending spine 20 in the refrigerator compartment 12 which extends continuously from the top 11 of cabinet 12 to the floor 13, although in some embodiments, the spine need not extend the entire height of the refrigerator. Similarly, the freezer compartment 14 includes a spine 30 which likewise extends from the top wall 31 continuously to the floor 33. Doors 16 and 18 also can include spines, such as spine 40, shown in door 16 and extending from the top edge 41 to the bottom edge 43, while freezer door 18 also may include a spine, such as spine 50 extending from the top edge 51 to the lower edge 53 of the door. Each of the spines 20, 30, 40, and 50 can be of substantially similar construction, typically extruded, formed, or molded of a suitable material typically used in the manufacture of refrigerators including extruded aluminum or sheet steel, or extruded or molded polymeric materials such as polyurethane, polyethylene, polyvinylchloride, polypropylene, or polystyrene.

The refrigerator 10 includes several modules including, for example, as shown in FIG. 1, a first module 22 positioned at a lower end near the floor 13 of cabinet 12 and a second module 24 positioned adjacent and above module 22. Both modules may receive utilities such as fluids and electrical power or signals from the spine 20, as described in greater detail below. Refrigerator cabinet 12 also includes a plurality of shelves 25-27 which can be placed in infinitely adjustable vertically spaced relationship depending upon the desire of the user.

Similarly, the freezer compartment 14 includes modules 32 and 34, which are vertically stacked and located near the floor 33 of the freezer compartment and are coupled to the spine 30 for potentially receiving cold air, fluid such as water if the modules is an ice maker, and electrical operating power for an ice making auger, as an example. The freezer compartment 14 also may include a plurality of shelves 35-37, which likewise are infinitely adjustable to any height selected by the user. Doors 16 and 18 include spines which can receive bins, such as bins 42, 44, 46, 47 and 48, again infinitely adjustably positioned on spine 40. Freezer door 18 likewise may include modules such as an ice maker/water dispenser 52 coupled to spine 50 for receiving water and electrical power for operating the ice maker/water dispenser, an upper storage bin 54, intermediate bins or shelves 56 and 58, for the storage of particular items in a user-selected location anywhere along the vertical height of spine 50.

Figure 3:
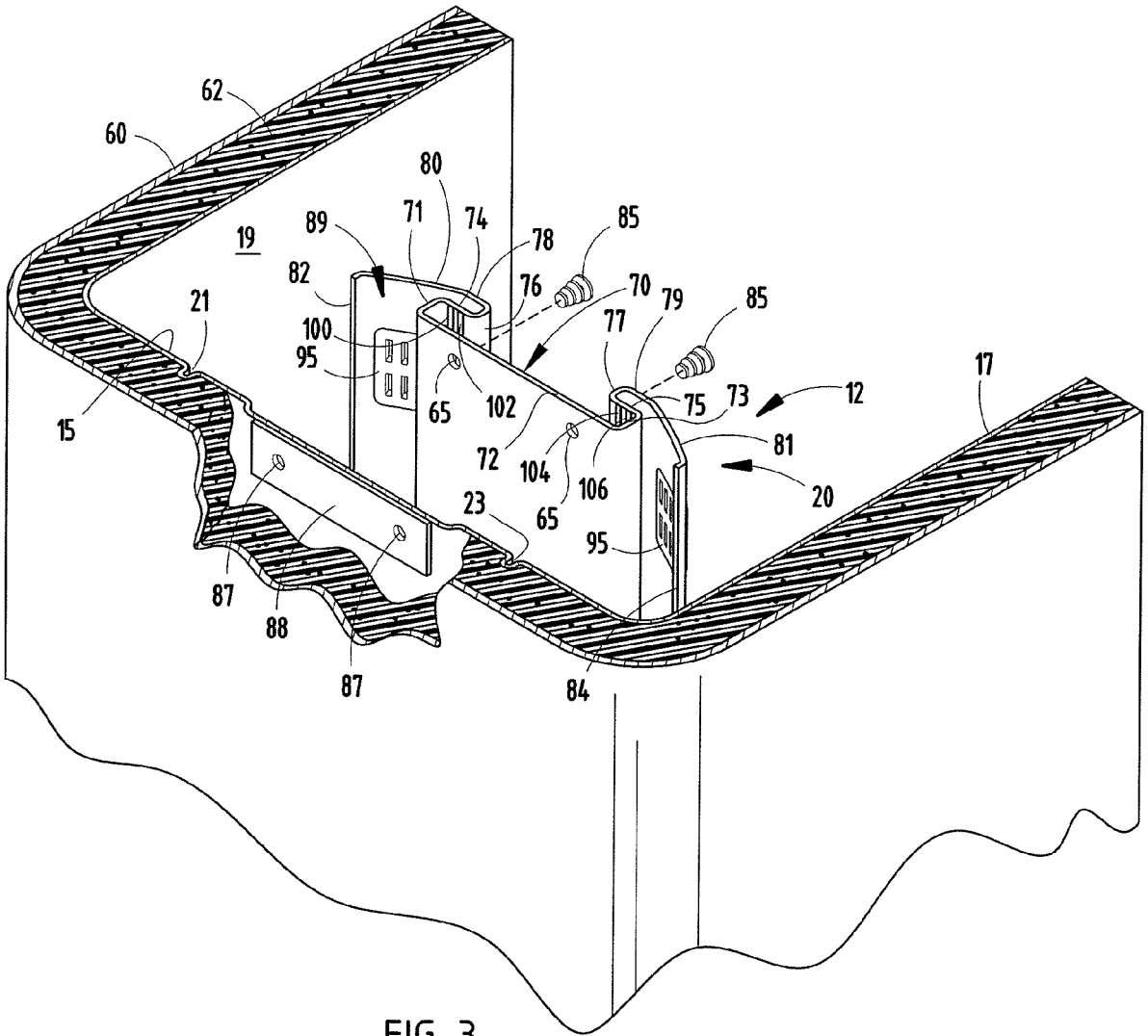
FIG. 3 is an exploded fragmentary perspective view of a spine, illustrating the assembly of the spine to a wall of the refrigerator cabinet or door.
Figure 4:
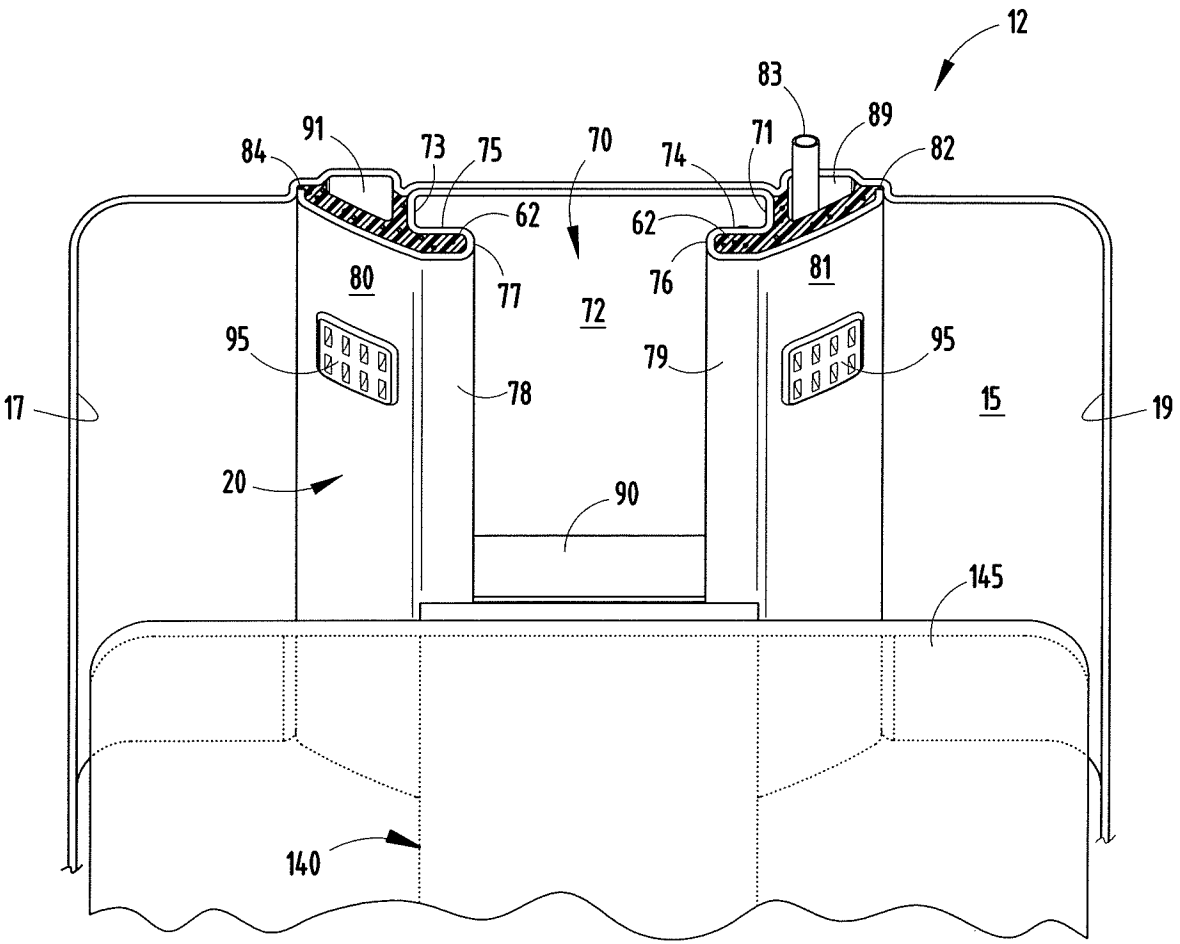
FIG. 4 is a fragmentary perspective cutaway view of the mounting of a shelf to a spine embodying the present invention.
Figure 5:
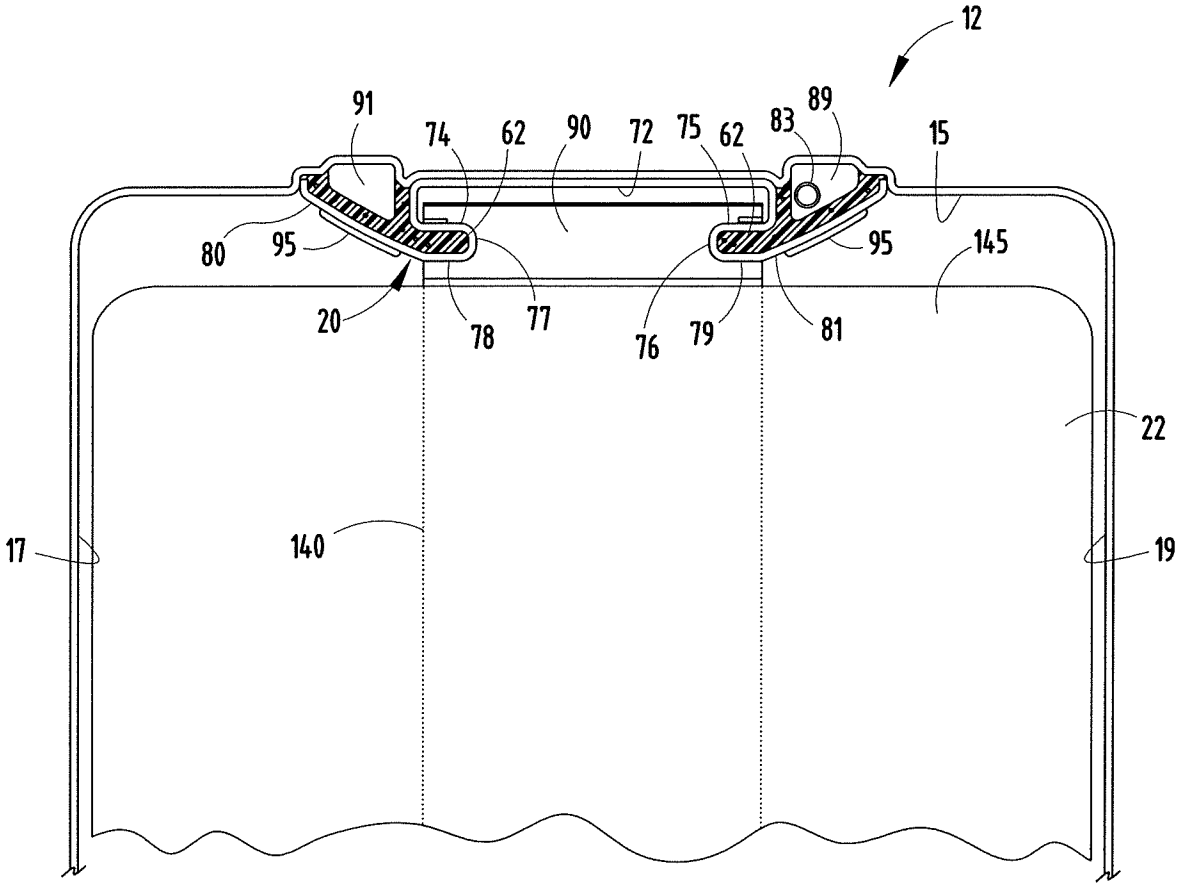
FIG. 5 is horizontal cross-sectional view of a module mounted to the spine

FIG. 3 illustrates the mounting of one of the spines, such as spine 20 to the rear wall 15 of refrigerator cabinet 12, it being understood that a similar mounting arrangement is employed for each of the cabinets of the refrigerator as well as the doors. Cabinet 12 includes, as best seen in FIG. 3, a rear wall 15 and side walls 17 and 19. The refrigerator 10 includes an outer cabinet 60 typically made of metal and an insulating layer 62 extending between the liner including the walls 15, 17, and 19, and the outer cabinet 60. As best seen in FIGS. 3-5, the spine 20 includes a continuously extending mounting member which in the preferred embodiment is a channel 70 for receiving mating mounting member such as a flange 90 of each of the shelves and/or modules which are mounted to the various spines. It should be understood that the respective mounting structures or connectors could be reversed with the spine including a continuously extending T-shaped outwardly extending flange and the shelves and modules including a mating channel-like member.

Channel 70 is defined, as best seen in FIG. 3, by a rear wall 72, side edges 71 and 73 extending outwardly therefrom, inwardly turned edges 74 and 75 which communicate with an outwardly extending lip 76 and 77 integrally formed with the remaining sections of channel 70. The spine also preferably integrally includes laterally outwardly extending flanges 78 and 79 substantially parallel with the edges 74 and 75 and rearwardly extending flanges 80 and 81 terminating in rearwardly extending an edge elongated tabs 82 and 84, respectively, which fit within and mate in elongated slots 21 and 23 in rear wall 15 of the refrigerator cabinet 12. The mating of edges 82 and 84 within slots 21 and 23 assist in positioning and stabilizing the vertically extending spine 20, which can be mounted to the liner or rear wall 15 of refrigerated cabinet 12 by a plurality of Christmas-tree type press-fit fasteners 85. Fasteners 85 extend through apertures 65 in wall 72 of spine 20 and fit within apertures 87 in reinforcing backing plate 88 positioned on the side of wall 15 opposite spine 20 to provide a secure coupling of the spine to the rear wall of the refrigerated cabinet. Similar spine construction and mounting construction is employed for the spines 30, 40 and 50 mounted to the freezer cabinet and the inside of the doors 16 and 18.

The spines, when mounted to the rear wall of cabinets 12, 14, define, as seen in FIGS. 4 and 5, a fluid flow path or conduits 89 and 91 in the spine for distributing cold air from plenums 29 (FIGS. 1 and 2) at the top of cabinets 12, 14 through a plurality of spaced outlets 95 formed in flanges 80 and 81 of the spine 20. These conduits 91 and 89 may also, however, provide space for receiving other fluid conduits, such as conduit 83 (FIG. 4) for water, a liquid coolant or gasses including, a vacuum line, air or inert gases, depending on the need for supplying particular modules with such utilities. Also, conduits 89 and 91, as shown in FIGS. 4 and 5, and the spine 20 itself may be insulated with insulation material 62, such that fluids transmitted through the conduits are not affected by the environment of the inside of the refrigerator.

In addition to the conduits 89 and 91 at the edges of mounting channel 70 of spine 20, spine 20 includes on the inner surface of edges 74 and 75 electrical conductors, such as conductors 100, 102, 104, and 106 (FIG. 3), which can be screen-printed in a conventional manner on the surface of the spine, if the spine is a nonconductive material. If the spine is made a Mylar layer is first position on the spine followed by the strips of conductive material to define the conductors for providing operating electrical power or electrical control signals for any of the modules secured to the spine 20. Thus, for example, module 22 shown in FIGS. 5 and 7 may include contacts 100',102',104' and 106' that engage and electrically connect to conductive strips 100,102,104, and 106 respectively powering or otherwise controlling a particular module such as module 22.

FIGS. 6-9 illustrate the manner by which modules and shelves are secured within the channel 70 of spine 20 and similar modules and shelves within the remaining spines of the refrigerator 10. The shelves and modules are mounted in a cantilevered manner by utilization of a T-shaped beam or flange, such as flange 90 shown in FIGS. 4-7. For a shelf such as shelf 140 in FIG. 6 will include a support platform 142 and a generally T-shaped flange 90 having a central section 96 and extensions 97 and 98 which fit within the slots or channels 70 of the spine 20, as best seen in FIGS. 4,5 and 8-10. The edges 97 and 98 similarly, in modules which require electrical operating power, include conductors 100', 102', 104' and 106' (FIG. 7), which mate with the correspondingly numbered conductors on the inner walls of edges 74 and 75 of the spine to provide electrical contact therebetween when the module, such as module 22 is installed on the spine, as shown in FIGS.

8 and 9. Each of the modules, such as module 22, or shelf, such as shelf 140, includes a T-shaped flange 90 with extensions or extending edges 97 and 98 defining opposed semicircular openings 93 and 99 to surround edges 76 and 77 of the spine, as best seen in FIGS. 5 and 8 and 9.

Figure 6:
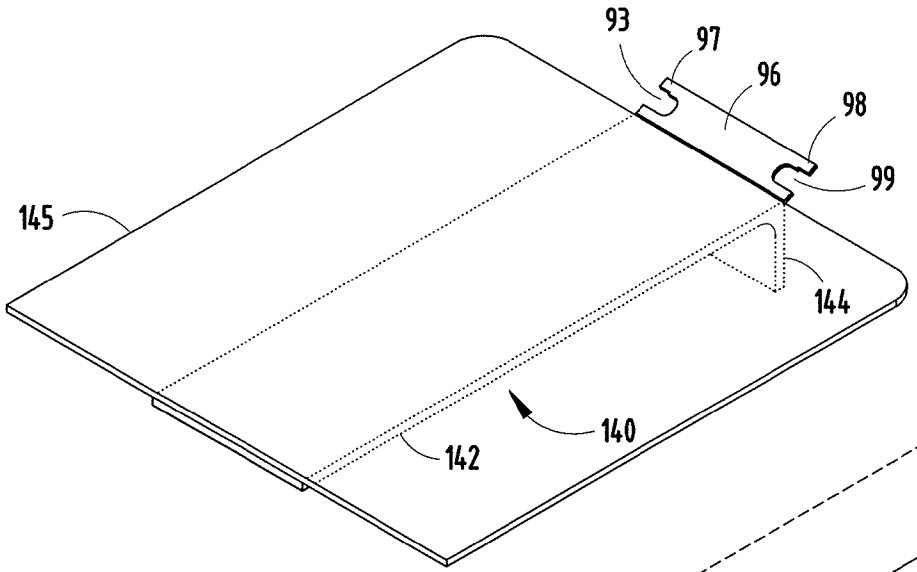
FIG. 6 is a perspective view of a shelf and bracket which can be mounted to a spine of the present invention.
Figure 7:
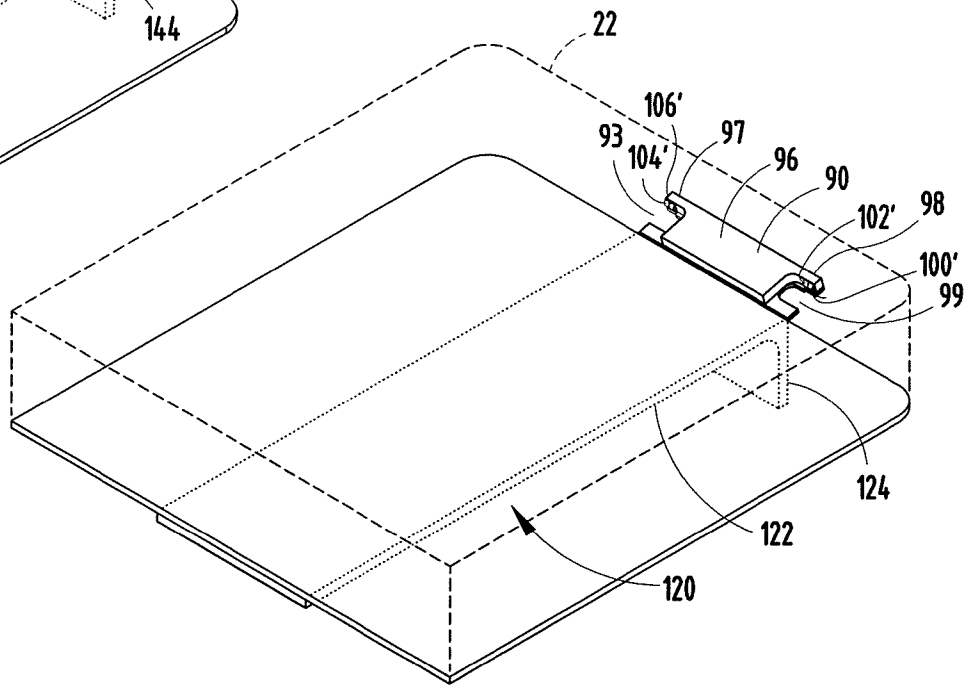
FIG. 7 is a perspective fragmentary view of the floor of a module including electrical contacts which mate with the spine.

Each of the modules and shelves further include an integral downwardly extending tang or support, as, for example, 124 and 144 shown in FIGS. 7 and 6, respectively, which is somewhat wider than the width of channel 70 and which rests on the outer surface of sections 78 and 79 of the spines to support the modules and shelves in a cantilevered fashion. Typically, the support structure or backbones 142 and 122 as shown in FIGS. 6 and 7 will support either a glass shelf, such as shelf 145 shown in FIG. 6, or the floor of a generally rectangular module typically comprising a bin and a drawer, such as 22 or 24 and shown in FIG. 1

Figure 9:
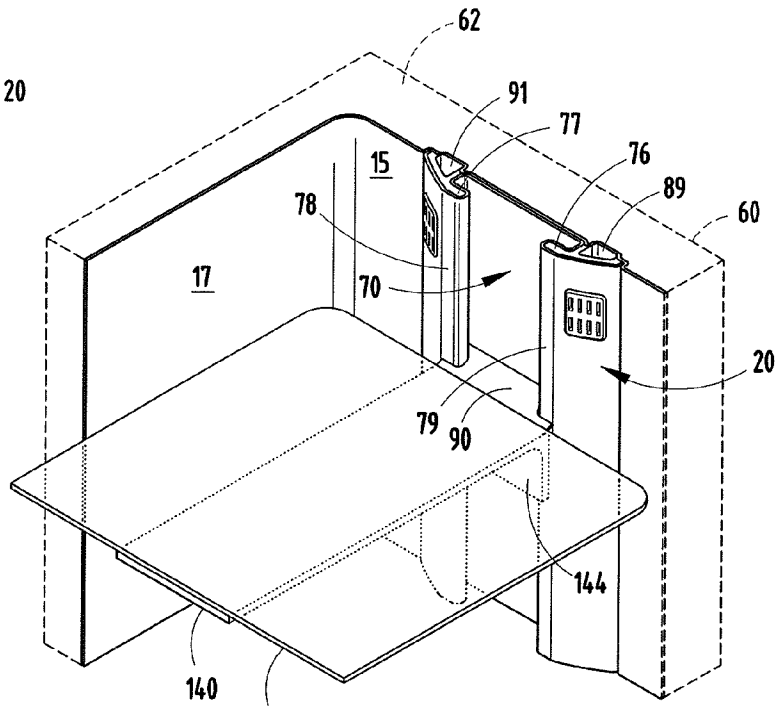
FIG. 9 is fragmentary perspective view illustrating the completion of the mounting of the shelf to the spine.
Figure 8:
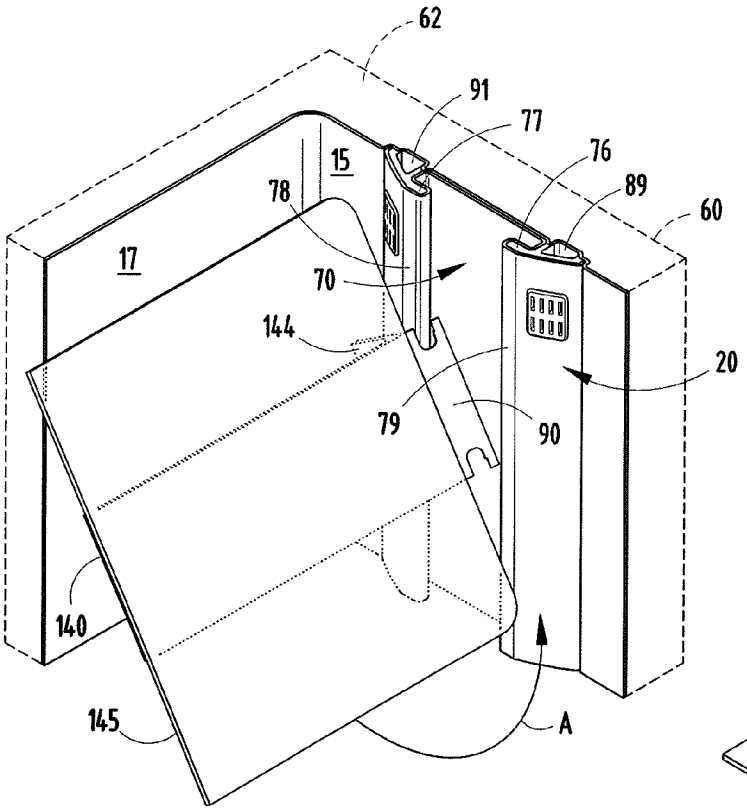
FIG. 8 is a fragmentary perspective view illustrating the mounting of a shelf to the spine.

As illustrated in FIGS. 8-9 the shelves and modules are installed by first canting the underlying support, such as supports 142 and 122 as illustrated in FIG. 8, at an angle such that the flange 90 clears lips 76 and 77 of channel 70 and, subsequently, rotate the shelf or module counterclockwise in the direction indicated by arrow A in FIG. 9 until the shelf or module is in a horizontal position, as illustrated in FIG. 9. In this position any electrical contacts are made and the downwardly extending tang or support 124 or 144 (FIGS. 6-7) rests against surfaces 78 and 79 of the spine 20. These supports are canted at a slight angle to provide the horizontal orientation of the shelves and modules with respect to the interior of the refrigerator.

Figure 10:
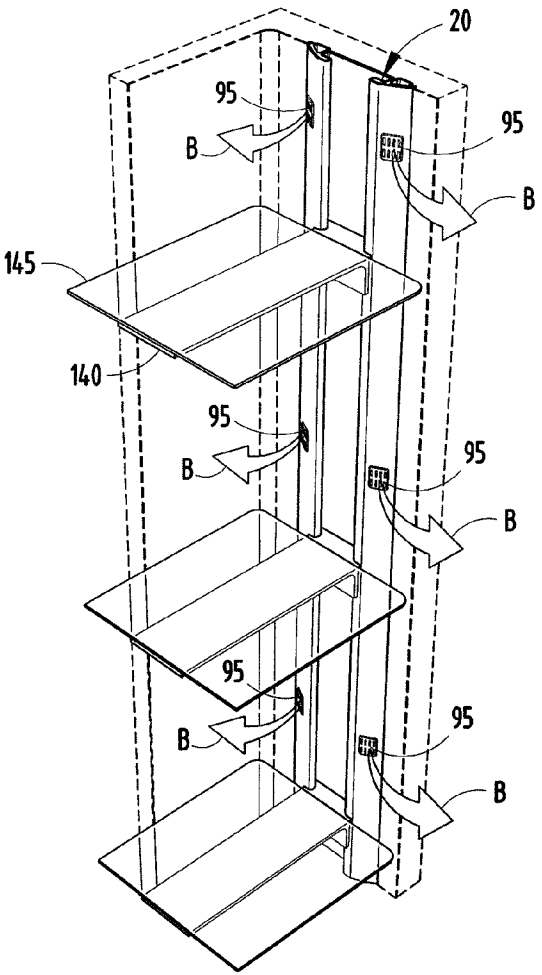
FIG. 10 is a fragmentary perspective view of the spine showing several shelves at selected locations.

The conduits 89 and 91 of spines 20 and 30 are employed for exhausting cold air from outlets 95, as indicated by arrows B in FIG. 10, to the interior of the refrigerator cabinet 12. Spine 30 in the freezer similarly expels colder air to the interior of freezer cabinet 14.

Figure 11:
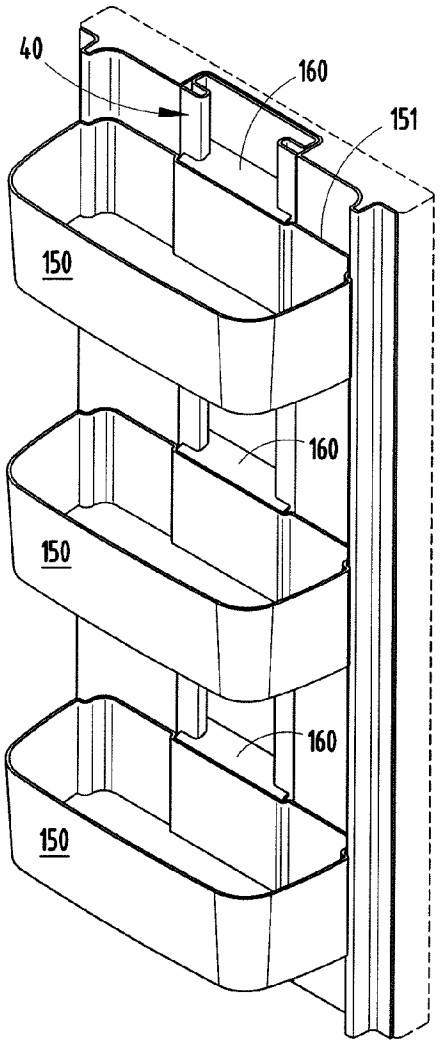
FIG. 11 is a fragmentary perspective view of a door showing several door bins mounted to the spine shown therein.
Figure 12:
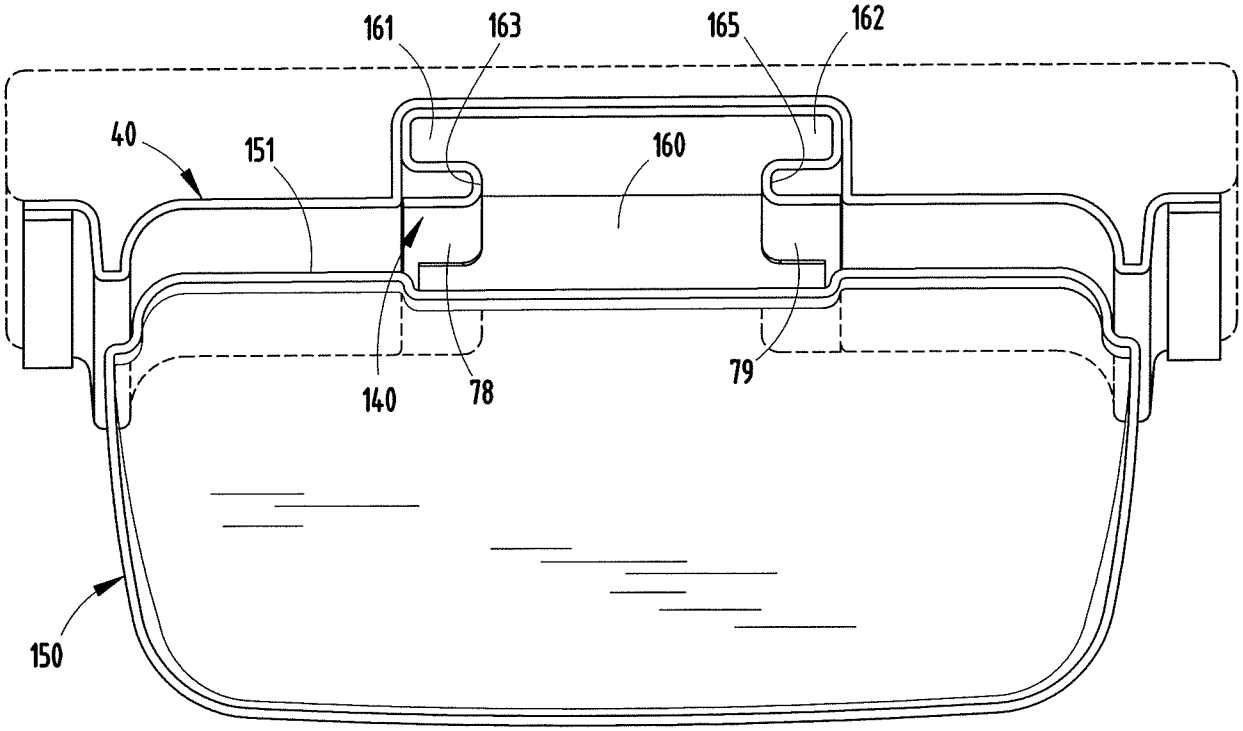
FIG. 12 is a horizontal cross-sectional view of one of the door bins shown in FIG. 11.

A similar mounting arrangement can be employed for mounting bins, such as bins 150 of FIG. 11, and modules 52, 54, and 58 (FIG. 1) for the doors 16 and 18, respectively, within spines 40 and 50. As shown in FIGS. 11-12, spine 40 has a construction substantially identical to spine 20 and similarly labeled elements. The door spines may not need to be as robust as the spines used for the cabinets 12 and 14 inasmuch as the bins and modules associated therewith will typically be somewhat smaller. The bins likewise include a vertically extending support extending from rear wall 151 of bin 150, for example, and a horizontally extending flange 160 having extensions 161 and 162, which extend within the slot channel 70 of spine 40 as seen in FIGS. 11 and 12, with the C-shaped slots 163 and 165 circumscribing the edges of the channel of spine 40 with the vertically extending support resting against the outer surfaces 78 and 79 of the spine 40 as in the prior embodiments. If, as for example, either of the doors includes modules requiring power and/or liquid, such as water, the spine channels can be insulated, as illustrated by the spine as shown in FIG. 4, to provide an insulated conduit for separate water lines and/or for the flow of a fluid other than cold air.

Thus, by providing elongated spines which extend generally vertically the height of the refrigerator in whatever configuration a refrigerator takes, a virtually infinite number of positions of adjustability are provided for both shelves and for modules which may require utilities, such as electricity, water or other liquids or fluids, or electrical control signals, is provided. This provides the purchaser of the refrigerator a great deal of flexibility in not only adjusting an existing refrigerator but also the ability to purchase additional modules for subsequent addition to an existing refrigerator with a spine system as disclosed herein. Additionally, the spine system facilitates the manufacture of a refrigerator utilizing the spine not only as conduits for the various fluids and electrical utilities but also a robust mount for the shelves and operating modules for the refrigerator.

It will become apparent to those skilled in the art that various modifications to the preferred embodiments of the invention as described herein can be made without departing from the spirit or scope of the invention as defined by the appended claims.

The invention claimed is:

1. A system for mounting a module to a support structure and for supplying electrical power, data or fluids thereto comprising:
- a support structure;
- an elongated spine coupled to said support structure for holding at least one module at any one of continuous locations along said spine;
- at least one of an electrical conductor and a fluid conduit positioned in said spine; and
- at least one module coupled to said spine, said module including at least one connector communicating with said spine for receiving one of electrical power or signals from said conductor.

2. The mounting system as defined in claim 1 wherein said module includes a second connector communicating with said spine for receiving a fluid from said conduit.

3. The mounting system as defined in claim 2 wherein said conductor is coupled to a source of electrical power and said conduit is coupled to a fluid source.

4. The mounting system as defined in claim 3 wherein said fluid source is a cooled air.

5. The mounting system as defined in claim 3 wherein said fluid source is a liquid.

6. A refrigerated compartment comprising:
- a cabinet having rear and side walls and an access door;
- an elongated spine supported within said cabinet and integrally including one of a channel or flange;
- at least one of an electrical conductor or a fluid conduit positioned in said spine;
- at least one module for mounting to said spine and including the other of at least one channel and flange for mechanically attaching said module to said spine for receiving operating power, data, or fluids from said spine at a selected location; and
- a connector on said module communicating with said spine for receiving electrical signals or power from said conductor.

7. The refrigerated compartment as defined in claim 6 wherein said spine includes a channel and said module includes a flange which fits within said channel for attaching said module to said cabinet.

8. The refrigerated compartment as defined in claim 7 wherein said spine integrally includes at least one air duct for coupling to a cooling source of air for providing cooled air from said spine into said cabinet.

9. The refrigerated compartment as defined in claim 8 wherein said spine includes a plurality of outlets for distributing cooled air throughout said cabinet.

10. The refrigerated compartment as defined in claim 8 wherein said spine includes a pair of air ducts on opposite sides of said channel and each of said ducts includes a plurality of air outlets.

11. The refrigerated compartment as defined in claim 6 wherein said electrical conductor is positioned on said spine to be engaged by said connector on said module.

12. An appliance comprising:
- a cabinet;

an elongated spine supported by said cabinet and including a continuously extending mechanical connector, said spine also including at least one of an electrical conductor or a fluid conduit; and at least one module having a mating mechanical connector for coupling said module to said mechanical connector of said spine at a selected location, said module including an additional connector for coupling to said spine for receiving operating power, data, or fluids from said spine at said selected location.

13. A spine system for supplying power, data, or fluids to one or more modules in a refrigerator comprising:

an elongated support member for mounting to a refrigerator, said support member including a continuous mounting member and including at least one electrical conductor and at least one fluid conduit extending along at least a portion of said elongated support member; and one or more modules coupled to said mounting member of said support member for receiving operating power, data, or fluids from said spine.

14. The spine system as defined in claim 13 wherein said mounting member comprises an open channel with inwardly extending edges.

15. The spine system as defined in claim 14 wherein each of said modules include a mounting flange for extending within said channel to be captured by said edges.

* * * * *